US008844105B2

(12) United States Patent
LaRoche

(10) Patent No.: US 8,844,105 B2
(45) Date of Patent: Sep. 30, 2014

(54) DEVICE AND METHOD FOR ASSEMBLY OF FURNITURE

(75) Inventor: John LaRoche, Gardner, MA (US)

(73) Assignee: Jeffco Fibres, Inc., Webster, MA (US)

( * ) Notice: Subject to any disclaimer, the term of this patent is extended or adjusted under 35 U.S.C. 154(b) by 524 days.

(21) Appl. No.: 13/092,623

(22) Filed: Apr. 22, 2011

(65) Prior Publication Data

US 2012/0267938 A1 Oct. 25, 2012

(51) Int. Cl.

| | |
|---|---|
| ***B68G 7/00*** | (2006.01) |
| ***A47C 3/16*** | (2006.01) |
| ***A47C 17/02*** | (2006.01) |
| ***A47C 31/11*** | (2006.01) |
| ***A47C 5/12*** | (2006.01) |

(52) U.S. Cl.

CPC . *A47C 3/16* (2013.01); *A47C 17/02* (2013.01); *A47C 31/11* (2013.01); *A47C 5/125* (2013.01)

USPC ..... 29/91.1

(58) Field of Classification Search

USPC ..... 29/91.1, 91

See application file for complete search history.

(56) References Cited

U.S. PATENT DOCUMENTS

| | | | | |
|---|---|---|---|---|
| 3,273,180 | A * | 9/1966 | Feinerman | 5/655.9 |
| 3,311,408 | A * | 3/1967 | Sarvas | 297/218.3 |
| 3,988,034 | A * | 10/1976 | Fister, Jr. | 297/452.6 |
| 4,040,881 | A * | 8/1977 | Wallace | 156/93 |
| D337,210 | S | 7/1993 | Silverman | |
| 5,385,385 | A | 1/1995 | Silverman | |
| D369,493 | S | 5/1996 | LaRoche | |
| 5,681,090 | A * | 10/1997 | St. Thomas | 297/440.14 |
| 5,762,842 | A * | 6/1998 | Burchi et al. | 264/46.4 |
| 5,829,834 | A | 11/1998 | Silverman | |
| 6,859,960 | B1 | 3/2005 | Jerome | |
| 7,040,700 | B2 * | 5/2006 | Duncan et al. | 297/218.4 |
| 7,207,627 | B2 | 4/2007 | Jerome | |
| D627,172 | S | 11/2010 | LaRoche et al. | |
| D639,569 | S | 6/2011 | LaRoche et al. | |
| 2006/0199456 | A1 * | 9/2006 | Taylor | 442/224 |
| 2011/0187176 | A1 * | 8/2011 | Besnard et al. | 297/452.48 |

* cited by examiner

*Primary Examiner* — Milton Nelson, Jr.
(74) *Attorney, Agent, or Firm* — Burns & Levinson, LLP

(57) ABSTRACT

Furniture, such as a chair, and method of assembly thereof includes the steps of configuring an upholstery fabric outer covering and a flap having one or more open sides, the flap affixable on one side to the outer covering. A number of foam blocks are configured in shapes, which, taken together, conform to the shape of the furniture to be assembled.

10 Claims, 8 Drawing Sheets

DEVICE AND METHOD FOR ASSEMBLY OF FURNITURE

DESCRIPTION RELATIVE TO THE RELEVANT ART

The manufacturing of furniture is a technology which is thousands of years old. The ancient Greek klismos, a chair which appears on urns circa 1500 BC, could reasonably be sold in furniture stores today. That is to say, many of the ancient technologies which were used in the making of furniture are, in many cases, still used, as are the designs themselves.

However, the availability of modern materials have also provided for entirely new technologies in the making of furniture. One of these is the use of plastics of various kinds, including foam plastics, such as polyurethane, in the manufacture of bedding, chairs and sofas.

The relevant art has many examples of the use of such foams in chairs, exemplified by the chair appearing in U.S. Pat. No. 3,988,034. Although plastic foam is used in this chair, the chair still requires the use of reinforcement rods and chains, to give it structural support. The same is also true of U.S. Pat. No. 4,092,049, which utilizes tubular supports in addition to the foam pieces and outer fabric.

The present chair and method of assembly uses the polyurethane foam components themselves to provide structural stability, which is further enhanced by the location of the foam blocks relative to each other, as well as by the restraint of the upholstery fabric, which prevents the foam blocks from moving relative to each other once the chair has been fully assembled.

Although a chair is used as a pertinent example of a device which is useful in describing the present device and method of assembly, it is clear that the technique can be used to produce other forms of furniture as well.

Summary of the Chair and Method

The chair and method described herein has the objective of providing a robust, low-cost, piece of furniture which does not require any rods, braces, struts, or other, strictly structural components. It has a further objective of making the resulting product so easy to assemble that it can be done by the end user or consumer without requiring any tools to do so.

In accordance with one aspect of the chair and method, the method for constructing a chair includes the steps of configuring an upholstery fabric outer covering and a flap having one or more open sides, the flap affixed on one side to the outer covering, the flap further including means for attaching the open sides of the flap to the outer covering.

In accordance with a second aspect of the chair and method of assembly a number of foam blocks are configured in shapes which, taken together, conform to the shape of the chair to be assembled.

In accordance with a third aspect of the invention the foam blocks are disposed within the outer covering so that the foam blocks completely fill the outer covering and cause it to assume the form of the chair.

In accordance with a fourth aspect of the chair and method the attachment is made by zipper or by a hook and loop fastener.

In accordance with a fifth aspect of the method it further includes the steps of inserting a plurality of slippery film sheets about one or more of the foam blocks to facilitate the insertion of said foam blocks within the outer covering.

In accordance with a sixth aspect of the chair and method one or more foam blocks are inserted into the outer fabric to form each arm of the chair.

In accordance with a seventh aspect of the chair and method one or more foam blocks are inserted into the outer fabric to form the back of the chair.

In accordance with an eighth aspect of the chair and method, one or more foam blocks are inserted into the outer fabric to form the base of the chair.

In accordance with a ninth aspect of the method of assembly, it includes the steps of shipping the chair components without the foam blocks having been inserted into the outer covering, and wherein the foam blocks and the slippery film sheets are packed separately from the outer covering.

In accordance with a tenth aspect of the method of assembly, the method includes the steps of offering the chair for resale whereby the purchaser is responsible for the assembling the chair from the outer covering, the foam blocks, and the slippery film sheets provided by the seller as a kit.

In accordance with an eleventh aspect of the chair and method the foam blocks are comprised of polyurethane.

BRIEF DESCRIPTIONS OF DRAWINGS

These, and other aspects of the chair and method may be understood by referring to the drawings contained herein, in which.

DESCRIPTION OF THE EMBODIMENTS

In the description herein, the resulting chair is described as "robust". In this context, the word "robust" is used to mean that the chair will maintain its shape when a person of reasonably normal size, of a class for whom the chair is intended, sits in the chair, repeatedly over the life of the chair, with the chair maintaining its shape as when first assembled, to the same degree as do other chairs, commercially available for the same use.

The present method was originally created for the manufacture of an infant's chair, having a very simple design, and being small in dimension. The extensive use of polyurethane foam in furniture is well known, and has become a mature technology, being used in beds, pillows, mattress toppers, and the like. It is now being used in chairs and sofas as well.

The relevant art includes many design of such foam-filled furniture. However, most of these designs require internal support structures of wood, metal and plastic to support the shape of the design. In contrast, the present design does not require any of the supporting structures of the relevant art, but rather uses the foam itself, together with the upholstery fabric, to restrain the foam in the form of the chair, and to provide structural support of the chair.

Figure 2:
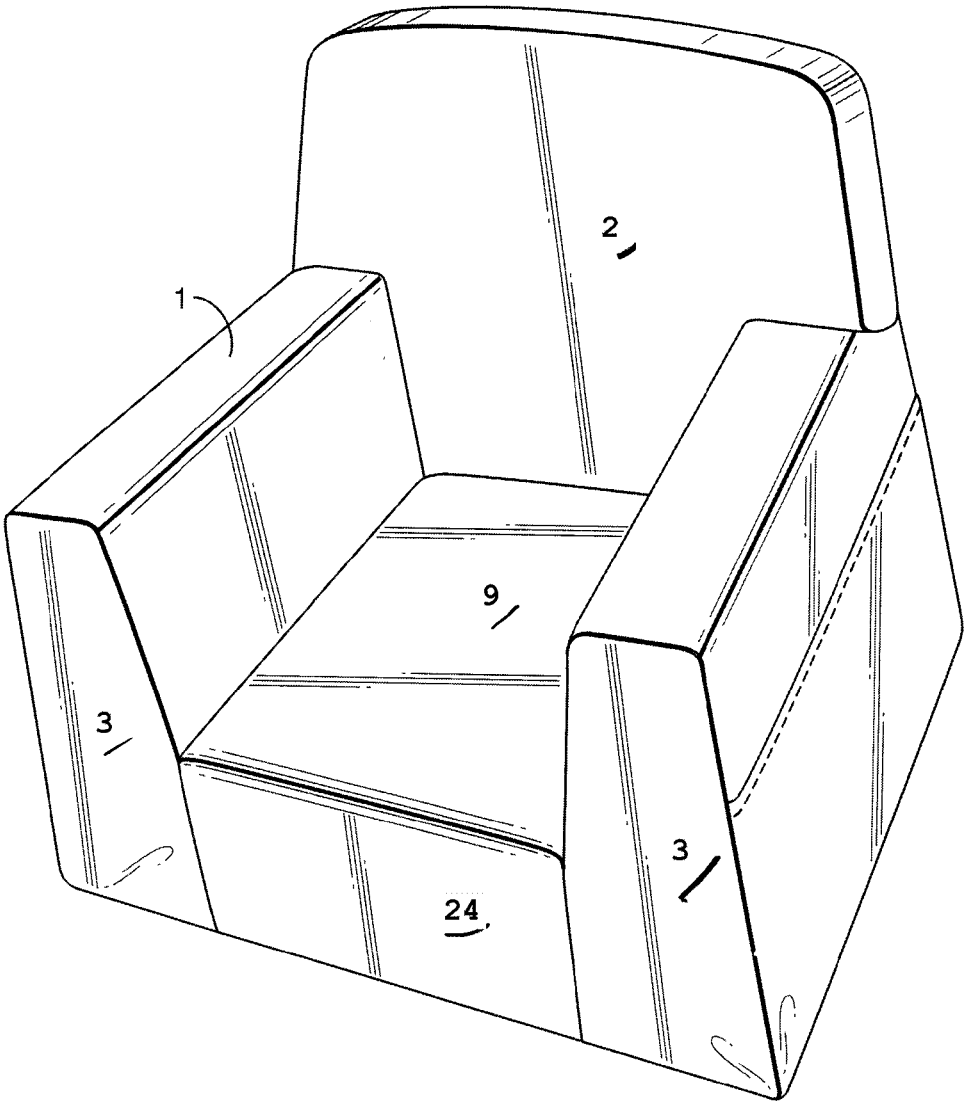
FIG. 2 depicts the chair after assembly by the present chair and method in perspective view.
Figure 8:
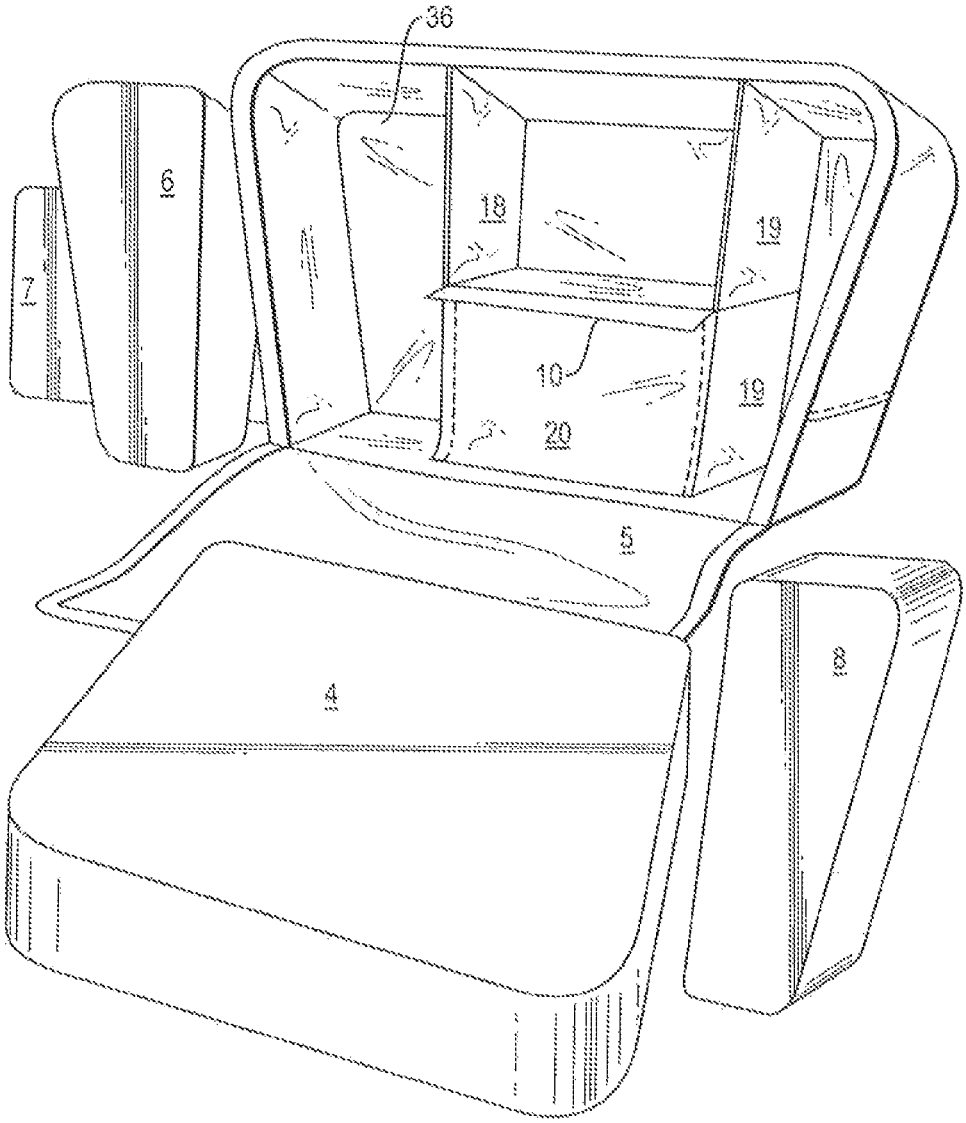
FIG. 8 depicts the chair in perspective view, with the flap in open position, the back block, base block, and both arm blocks removed.

The figures, starting with FIG. 2 and continuing on in order to FIG. 8, depict a progressive dis-assembly of the chair. Starting with FIG. 8, and progressing in reverse order to FIG. 2 depicts the steps in the assembly of the chair.

Referring first to FIG. 2, a typical chair, constructed in accordance with the present invention, is depicted. The chair comprises the elements shown: the upholstery fabric 1 covers the structure, which includes a seat 9, with an arm 3 on each side of the seat, a back support 2, and a lower front section 24. The fabric itself is composed of a polyester micro-suede in a first embodiment, said fabric being well known in the relevant art.

Figure 3:
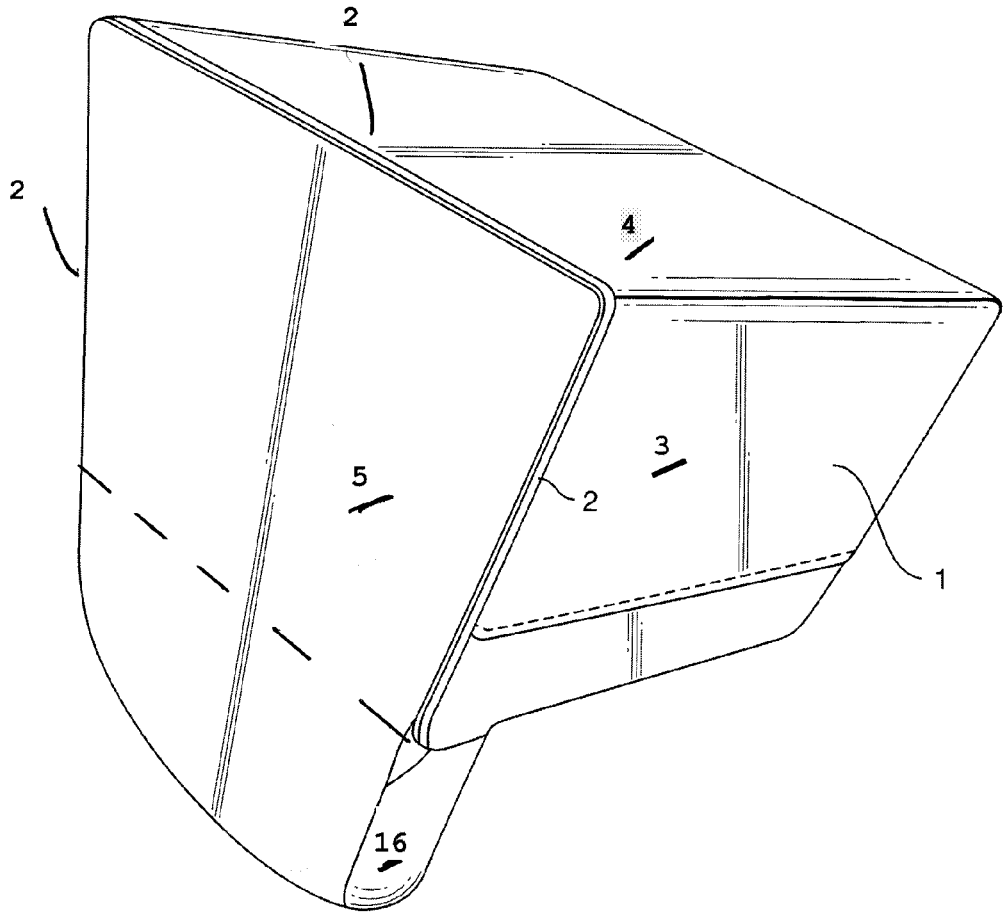
FIG. 3 depicts the chair after assembly by the present chair and method in perspective view, showing the chair bottom.

The chair, when fully assembled, is shown in FIG. 3 turned upside-down, so that the top part of the back rest 16 is beneath the rest of the chair. The back of the back rest 5 is in the form of a flap, which is affixed to the arm sides 3 by a zipper 2 which extends from the back of one of the arm sides 3, across the back of the chair bottom 4, and up the other arm side 3. In an alternative embodiment, a hook and loop fastener may be used in place of the zipper to secure the flap so that it appears to be a continuation of the upholstery fabric itself.

Figure 4:
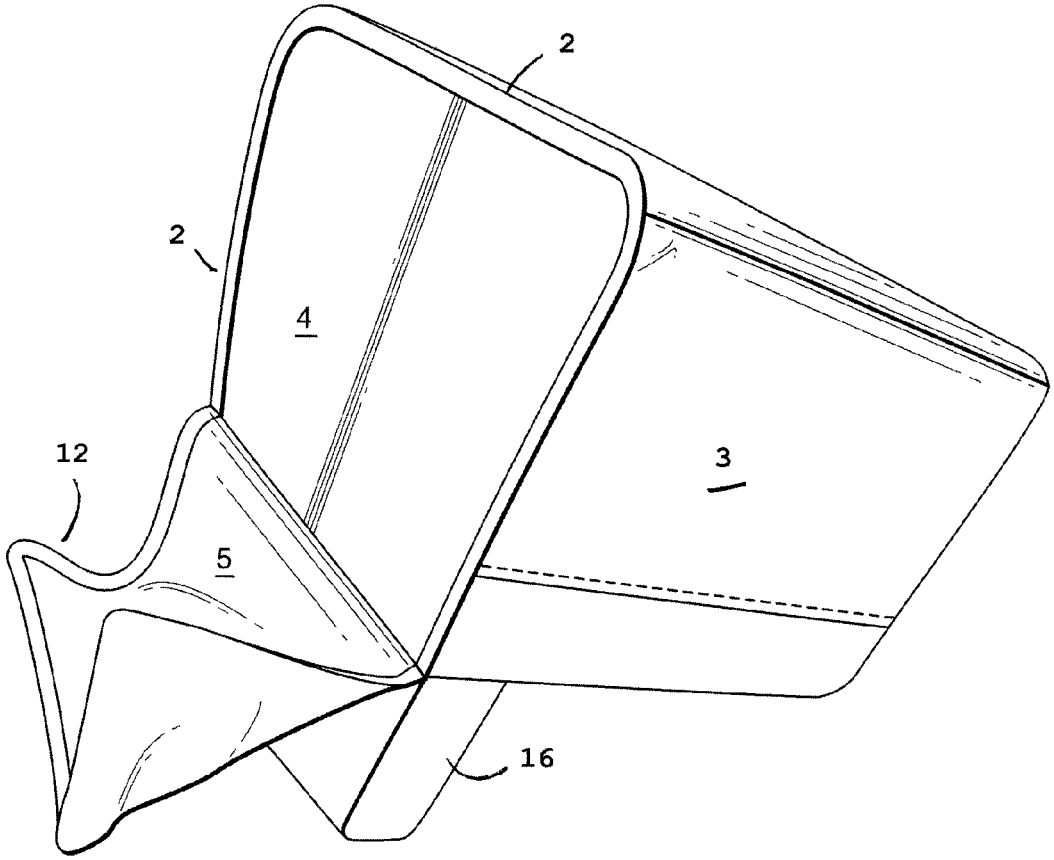
FIG. 4 depicts the chair after assembly by the present chair and method in perspective view, with the flap in open position, and with the back block seen.

Referring now to FIG. 4, the flap 5 has been unzipped, so that it exposes the back block 4. This back block, like the other foam blocks, is made of polyurethane in this first embodiment. It can be seen in this figure that the letter "D" appears on the block itself, which is an aid to assembling the chair, as will be further described infra.

Figure 5:
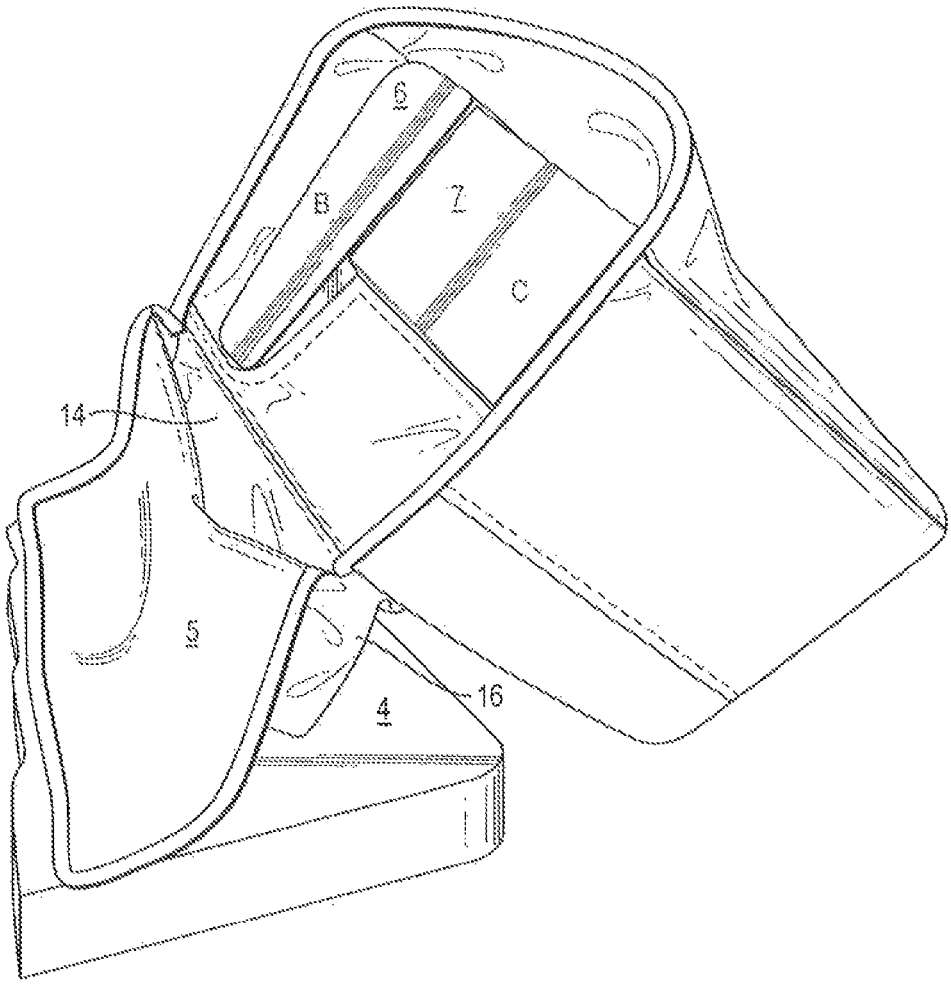
FIG. 5 depicts the chair in perspective view, with the flap in open position, the back block removed, and the other blocks seen.

Referring next to FIG. 5 the back block 4 has been removed, and appears beneath the rest of the chair. The top of the back rest 16 is also shown in this figure, which no longer appears in the form it did in FIG. 4, since the back block 4, being removed, leaves the top of the back as a limp, formless piece of fabric. The back rest socket 14, in which the top of the back block resided before it was removed, is visible in this drawing. With the back block removed, the other blocks may be seen. The base block 7 is surrounded by the right arm block 6, and the left arm block, which is not, however, visible in this figure because of the angle of the drawing. However, the left arm block is the mirror image of the right arm block, as may be seen by referring next to FIG. 6.

Figure 6:
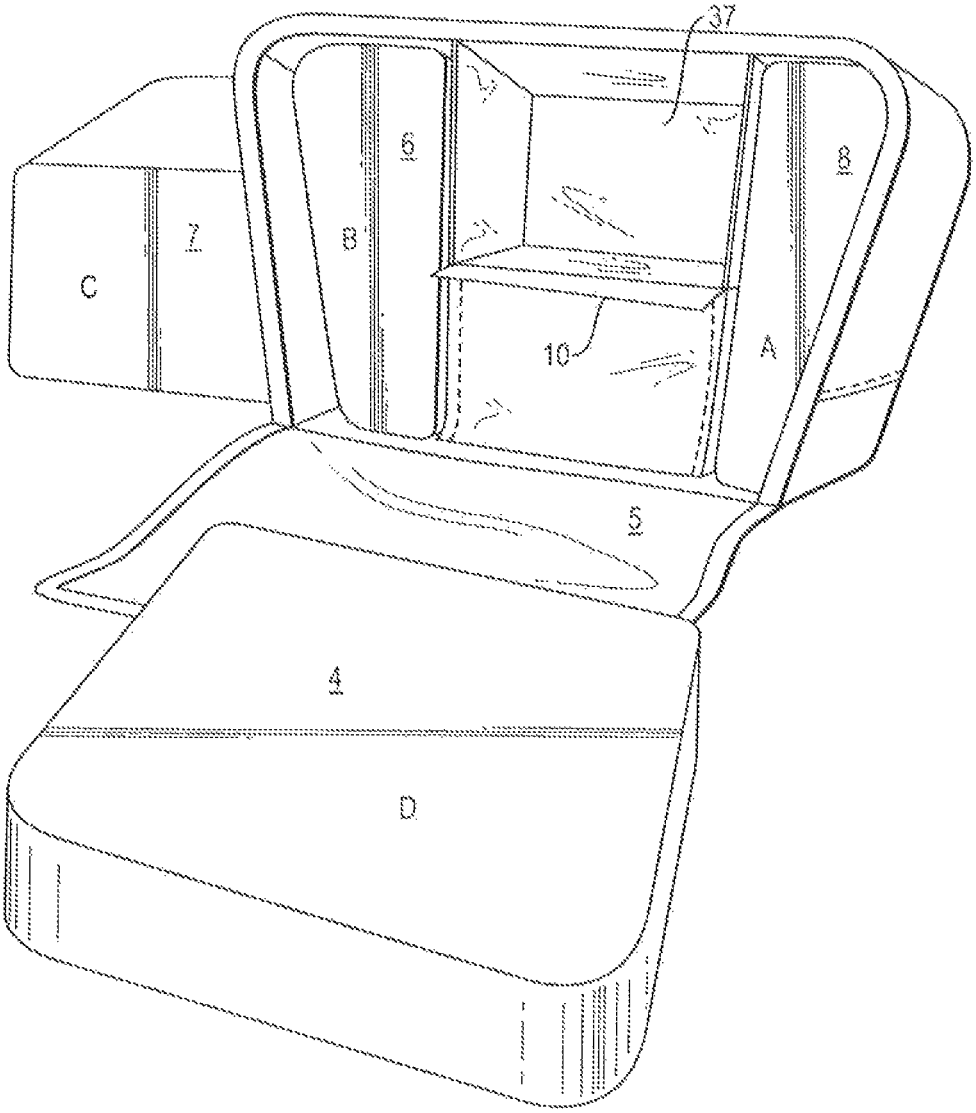
FIG. 6 depicts the chair in perspective view, with the flap in open position, the back block and base block removed.

Referring further to FIG. 6, the seat socket 37 is shown, which is visible since the seat block 7 has been removed. The letter "C" is written on the block as an aid to assembling the seat. The arm blocks 6, 8 have letters "B" and "A" written on them in a like manner, also as an assembly aid. If, during assembly, the block with letter A is inserted first, then the block with letter B next, and so on in alphabetic order, the chair will be assembled in the optimal fashion.

Also visible in the is figure is tab 10, which assists in the assembly of the chair, as will be described infra.

Figure 7:
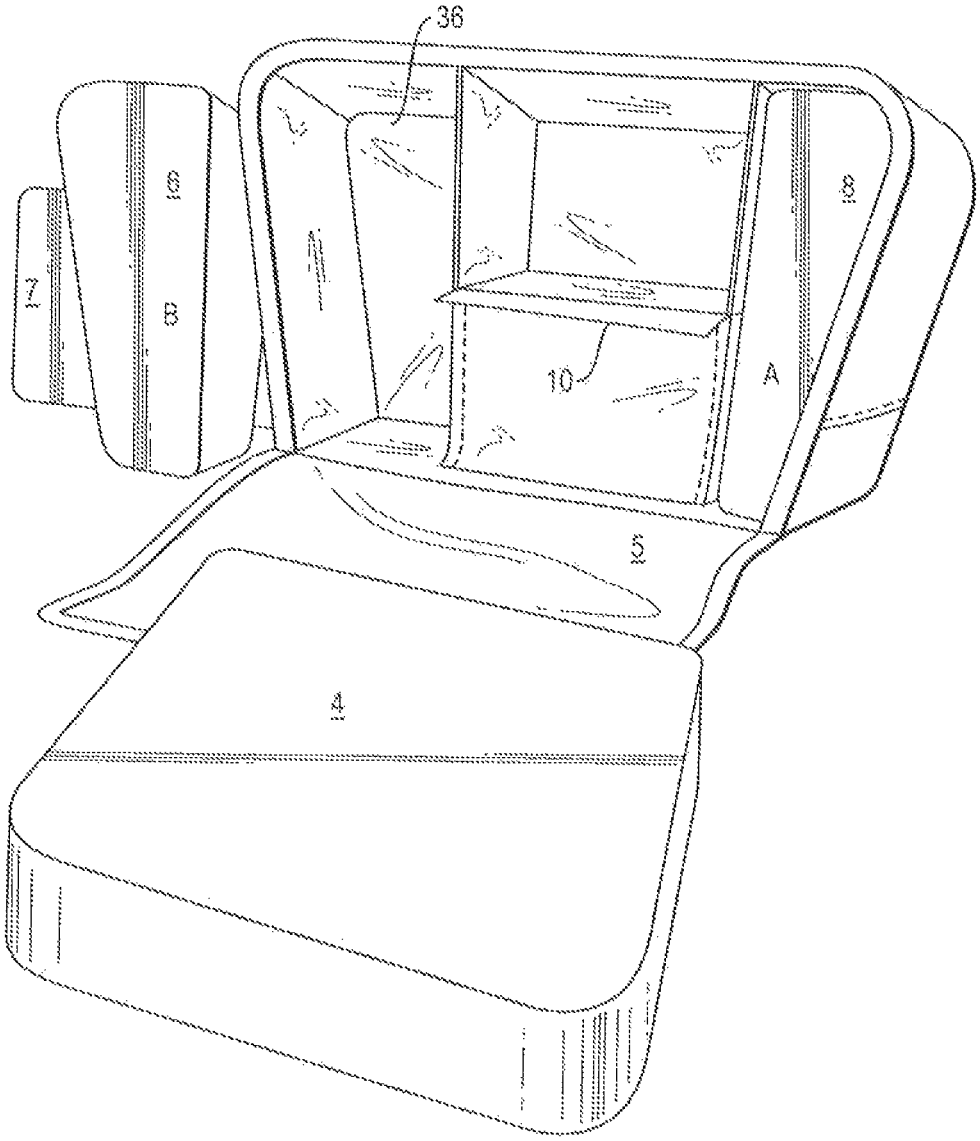
FIG. 7 depicts the chair in perspective view, with the flap in open position, the back block, base block, and one arm block removed.

Referring next to FIG. 7, the right block 6 has been removed, exposing right arm socket 36, while the final step in the disassemble is seen in FIG. 8, wherein the left arm block 8 has been removed, and the various panels are visible. The side panels 18 and 19 are made of a flexible cloth fabric. The front panel 20, is part of the backing of the micro-suede upholstery fabric.

Figure 1:
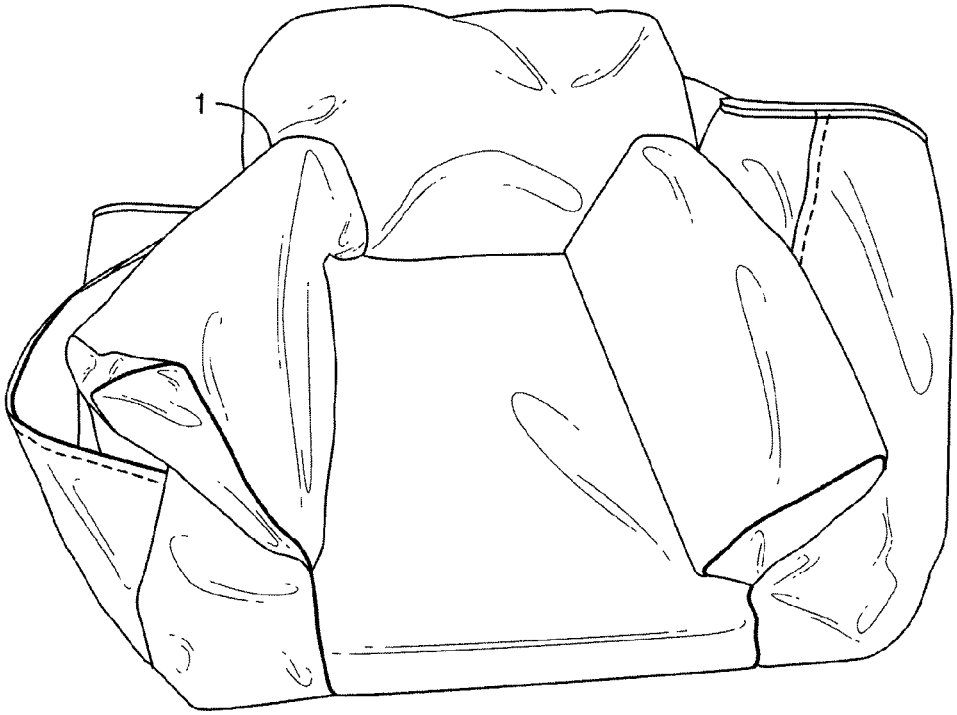
FIG. 1 depicts the upholstery material forming the outer cover of the chair, in perspective view.

Although FIG. 8 shows the chair as maintaining a semblance of its structure, the chair will generally collapse in a heap, as shown in FIG. 1, once all of the foam blocks have been removed.

To assemble the chair, the steps just described are performed in reverse order. Starting with the state as shown in FIG. 8, the two arm block are inserted, leaving the chair in condition as shown in FIG. 6. The tab 10, is pulled toward the viewer in these figures after the seat block 7 is inserted into the seat socket 37. The tab is composed of the same backing material as used elsewhere inside of the micro-suede upholstery material. By pulling on the tab 10, any wrinkles which still exist are pulled out of the seat and the arms, providing a smooth, finished look to the assembled chair.

Once the back block 4 has been finally inserted into the back rest socket 14, the zipper 2 is zipped around the periphery of the back of the chair, which pulls any remaining wrinkles out of the chair.

One of the advantages of the type of construction described herein is that the chair may be sold in disassembled form. In today's economy, many products, including toys, furniture, garden implements, etc. are sold in disassembled form, leaving it to the purchaser to assemble the product after purchase. The assembly by the purchaser has the obvious advantage of reducing the cost of manufacturing, which cost reduction may be passed on to the purchaser. Furthermore, the cost of transportation is reduced by the use of this method, since the components of the chairs can be stacked more tightly as compared to the assembled chairs.

Alternatively, the non-assembled products may be shipped by the manufacturer to resellers, who can purchase them as kits at a reduced cost, and assemble them before selling them as finished products to retail purchasers.

In an additional embodiment the ease of assembly can be enhanced by use of a slippery membrane material between the components as they are assembled. The use of this material allows the plastic foam blocks to be easily slid into place within the corresponding sockets within a minimum of effort, and further allows for a perfect fit of the components. The use of such slippery membrane material is well known in the relevant art, including within the furniture industry.

The use of identifying letters, or other symbols, on the blocks has been previously discussed, and these letters may appear in an instruction manual supplied with the unassembled product. Additionally, in another embodiment, the inner cloth backing of the upholstery fabric may be made to contain the mating letter or other symbols, which appear on the corresponding foam blocks. In this embodiment the assembler simply inserts the plastic foam block with an identification number or symbol into the socket with the corresponding identification number or symbol. The identification symbols may also be arranged in preferred order of assembly as a further guide to the assembler.

The method of assembly just described has used an infant's chair as the item of furniture subject to this technique However, it should be obvious that this same technique can be used for other sizes and shapes of chairs, and for other articles of furniture as well, including, but not limited to, sofas.

While certain embodiments and examples have been used to describe the present method, many variations are possible and are within the spirit and scope of the method. Such variations will be apparent to those skilled in the art upon inspection of the specification and claims herein. Other embodiments are within the following claims.

The invention claimed is:

1. A method for constructing a piece of furniture comprising the steps of:

a. configuring an upholstery fabric outer covering comprising a plurality of sockets and a flap comprising one or more open sides, the flap affixed on one side to the outer covering;

b. selecting a plurality of foam blocks;

c. inserting one of the plurality of foam blocks within one of the plurality of sockets of the outer covering and repeating said inserting step until each of the plurality of foam blocks have been inserted into one of the plurality of sockets and all of the sockets are filled with a foam block, whereby the plurality of foam blocks completely fill the outer covering and form the piece of furniture;

d. attaching the open sides of the flap to the outer covering by a fastener; and, e. stabilizing the plurality of foam blocks such that the plurality of foam blocks cannot move relative to each other.

2. The method of claim 1, wherein said fastener comprises a zipper.

3. The method of claim 1, wherein step (c) further comprises inserting a plurality of slippery film sheets about one or more of the plurality of foam blocks.

4. The method of claim 1 wherein said piece of furniture comprises a chair.

5. The method of claim 1 further comprising the step of pulling a tab after a seat block is inserted into a seat socket, and removing wrinkles in the outer covering of the piece of furniture.

6. The method of claim 1 wherein said fastener comprises a hook and a loop.

7. The method of claim 1, wherein the plurality of foam blocks are comprised of polyurethane.

8. The method of claim 1, wherein the piece of furniture further comprises an arm, a back, and a base, and, wherein step (c) comprises inserting one or more foam blocks into the outer covering to form the arm of the piece of furniture, inserting one or more foam blocks into the outer covering to form the back of the piece of furniture, and inserting one or more foam blocks into the outer covering to form the base of the piece of furniture.

9. The method of claim 8, further comprising the step of shipping the outer covering and the unassembled plurality of foam blocks wherein the plurality of foam blocks are not inserted into the outer covering before shipping.

10. The method of claim 9, further comprising the step of offering the piece of furniture for resale whereby the purchaser is responsible for the reassembling of piece of furniture from the outer covering, the plurality of foam blocks, and the slippery film sheets.

* * * * *

UNITED STATES PATENT AND TRADEMARK OFFICE

CERTIFICATE OF CORRECTION

PATENT NO. : 8,844,105 B2
APPLICATION NO. : 13/092623
DATED : September 30, 2014
INVENTOR(S) : LaRoche It is certified that error appears in the above-identified patent and that said Letters Patent is hereby corrected as shown below:

In the Claims,

In Column 6, Line 19, claim 10, please replace --piece of furniture-- with --the piece of furniture--

Signed and Sealed this
Sixth Day of January, 2015

Michelle K. Lee

Michelle K. Lee
*Deputy Director of the United States Patent and Trademark Office*